US008888544B1

(12) United States Patent
Guglielmo

(10) Patent No.: US 8,888,544 B1
(45) Date of Patent: Nov. 18, 2014

(54) VERSATILE CONTROL HANDLE FOR WATERCRAFT DOCKING SYSTEM

(75) Inventor: Kennon Guglielmo, San Antonio, TX (US)

(73) Assignee: Enovation Controls, LLC, Tulsa, OK (US)

( * ) Notice: Subject to any disclaimer, the term of this patent is extended or adjusted under 35 U.S.C. 154(b) by 0 days.

(21) Appl. No.: 13/373,822

(22) Filed: Dec. 1, 2011

(51) Int. Cl.
*B63H 21/21* (2006.01)

(52) U.S. Cl.
USPC ..... 440/84

(58) Field of Classification Search
USPC ..... 440/84, 87; 345/167
IPC ..... B63H 21/213
See application file for complete search history.

(56) References Cited

U.S. PATENT DOCUMENTS

| | | | | |
|---|---|---|---|---|
| 2,402,724 | A | 6/1946 | Bidwell | |
| 3,085,447 | A | 4/1963 | Shay | |
| 3,940,674 | A | 2/1976 | Gill | |
| 4,691,659 | A | 9/1987 | Ito et al. | |
| 4,942,838 | A | 7/1990 | Boyer et al. | |
| 4,962,717 | A | 10/1990 | Tsumiyama | |
| 5,090,929 | A | 2/1992 | Rieben | |
| 5,362,269 | A | 11/1994 | Leach | |
| 5,392,871 | A | 2/1995 | McFarland | |
| 5,854,622 | A * | 12/1998 | Brannon | 345/161 |
| 6,230,642 | B1 | 5/2001 | McKenney | |
| 6,375,522 | B1 | 4/2002 | Bellens et al. | |
| 6,511,354 | B1 * | 1/2003 | Gonring et al. | 440/87 |
| 6,518,524 | B1 * | 2/2003 | Brandt et al. | 200/61.54 |
| 6,538,217 | B1 | 3/2003 | Eriksen et al. | |
| 6,684,803 | B1 | 2/2004 | Dickson | |
| 6,693,625 | B2 * | 2/2004 | Armstrong | 345/161 |
| 6,865,996 | B2 | 3/2005 | Borrett | |
| 6,896,563 | B1 | 5/2005 | Dickson | |
| 6,942,531 | B1 | 9/2005 | Fell et al. | |
| RE39,032 | E | 3/2006 | Gonring et al. | |
| 7,127,333 | B2 | 10/2006 | Avidsson | |
| 7,216,599 | B2 | 5/2007 | Morvillo | |
| 7,305,928 | B2 | 12/2007 | Bradley et al. | |
| 7,467,595 | B1 | 12/2008 | Lanyi et al. | |
| 7,524,219 | B2 | 4/2009 | Torrangs et al. | |
| 7,575,491 | B1 | 8/2009 | Martin | |
| 2007/0277721 | A1 | 12/2007 | Crotts | |
| 2009/0038523 | A1 | 2/2009 | Blagirev | |
| 2009/0093174 | A1 | 4/2009 | Rul | |
| 2009/0124144 | A1 | 5/2009 | Rul | |
| 2009/0173268 | A1 | 7/2009 | Morvillo | |

OTHER PUBLICATIONS

"Launching the Best Performance on the Water"; Zeus, Boat Control; www.cmdmarine.com/prop/zeusover.html; as early as Jul. 13, 2009.

(Continued)

*Primary Examiner* — Stephen Avila
(74) *Attorney, Agent, or Firm* — William H. Quirk; Daniel A. Rogers; Rosenthal Pauerstein Sandoloski Agather LLP

(57) ABSTRACT

A watercraft docking mode throttle control system incorporating a joystick assembly within the control lever knob which is part of the control lever assembly that is gripped and held by the operator of the boat during use. The incorporation of such a joystick assembly allows the operator to make more controlled adjustment to the movement of the boat when the boat is in docking operational mode.

21 Claims, 6 Drawing Sheets

(56) References Cited

OTHER PUBLICATIONS

"Joystick Docking System"; Axius System; www.mercruiseraxius.com; as early as Feb. 27, 2009.
"Joystick for Volvo Penta IPS"; Volvo Penta Global; www.volvopenta.com/volvopenta/global/en-gb/marine_leisure_engines/accessories/ips_accessories/joystick.com; as early as Feb. 27, 2010.
"CMD Beats Volvo Penta to Sterndrive Joystick System"; www.boattest.com/resources/view_news.aspx; Sep. 17, 2007.
"Axius", Mercury Marine; www.mercurymarine.com/engines/mercruiser/features/axius.com; as early as Jun. 1, 2011.

* cited by examiner

VERSATILE CONTROL HANDLE FOR WATERCRAFT DOCKING SYSTEM

CLAIM OF PRIORITY TO PRIOR APPLICATION

Under 35 U.S.C. 119 and 120, this application claims the benefit of the filing date of U.S. Provisional Application Ser. No. 61/418,029, filed on Nov. 30, 2010, entitled "Apparatus and Method for the Control of Docking Mode Engine Throttle for Inboard and Outboard Boat Motors," the entire contents and references of which are incorporated herein by this reference.

BACKGROUND

1. Field of the Invention

The present invention relates principally to the field of watercraft control systems and, more particularly, to the fields of throttle and transmission controls and joystick maneuvering systems for watercraft.

2. Related Art

The age-old boat throttle lever arm has survived the test of time as an indispensible controller choice for a vast array of boat designs. The throttle arm pivots forward and backward to control the magnitude of forward or rearward velocity of the boat based on how far it pivots from the vertical and, when vertical, the engine is kept in neutral and usually has to be released from neutral by pressing a mechanical or electrical release button, trigger or the like.

Since the advent of directed watercraft thrust systems and all of their versatile joystick control interfaces more than fifty years ago, helmsman have also long been able to easily maneuver their boats in all sorts of directions—forward, backward, sideways, and spin-on-a-dime-ways—all with the touch of a joystick. Many watercraft systems use such approaches, which are often commonly referred to as pod drives, azimuth thrusters, tunnel thrusters, dynamic propulsion, and Can-based propulsion. Some thrust systems include fixed-pitch propeller hydraulic and mechanical thrusters with direct engine drive, electric drive or hydraulic drive, and underwater mountable thrusters for a wide variety of marine applications. Such thrust systems commonly come with integrated or modular electronic control systems, with or without prime mover controls, and have become standardized in many respects.

Directed thrust systems are sometimes used as the primary propulsion system, but many different types of watercraft use a traditional propulsion system for typical and high-speed operation, together with an auxiliary directed thrust system for low-speed or dynamic maneuvering, such as for docking or the like.

A vast number of thrust systems and controller options are available from numerous commercial operations such as Volvo, Zeus, Mercury, ZF Marine, Mastercraft, ThrustMasters and EControls (Applicant), even for straight drives. The problems and obstacles of the prior art systems are evident to those of skill in the art and will be further evident from the following descriptions.

SUMMARY OF THE INVENTION

Principal objects of the present invention are to improve watercraft thrust systems and to enable versatile watercraft propulsion systems that overcome the obstacles of the prior art while also advancing the general objects of watercraft controls.

The scope of the invention will be appreciated from the accompanying claims, as they may be added, clarified or otherwise amended during the course of prosecution, and many other objects features and advantages will become evident from the following descriptions as considered in light of the prior art, and it is intended that such objects, features and advantages are within the scope of the present invention.

To the accomplishment of all the above and related objectives, it should be recognized that this invention may be embodied in the form illustrated in the accompanying drawings, attention being called to the fact, however, that the drawings are illustrative only, and that changes may be made in the specifics illustrated or described.

DETAILED DESCRIPTION OF THE PREFERRED EMBODIMENTS

Figure 1:
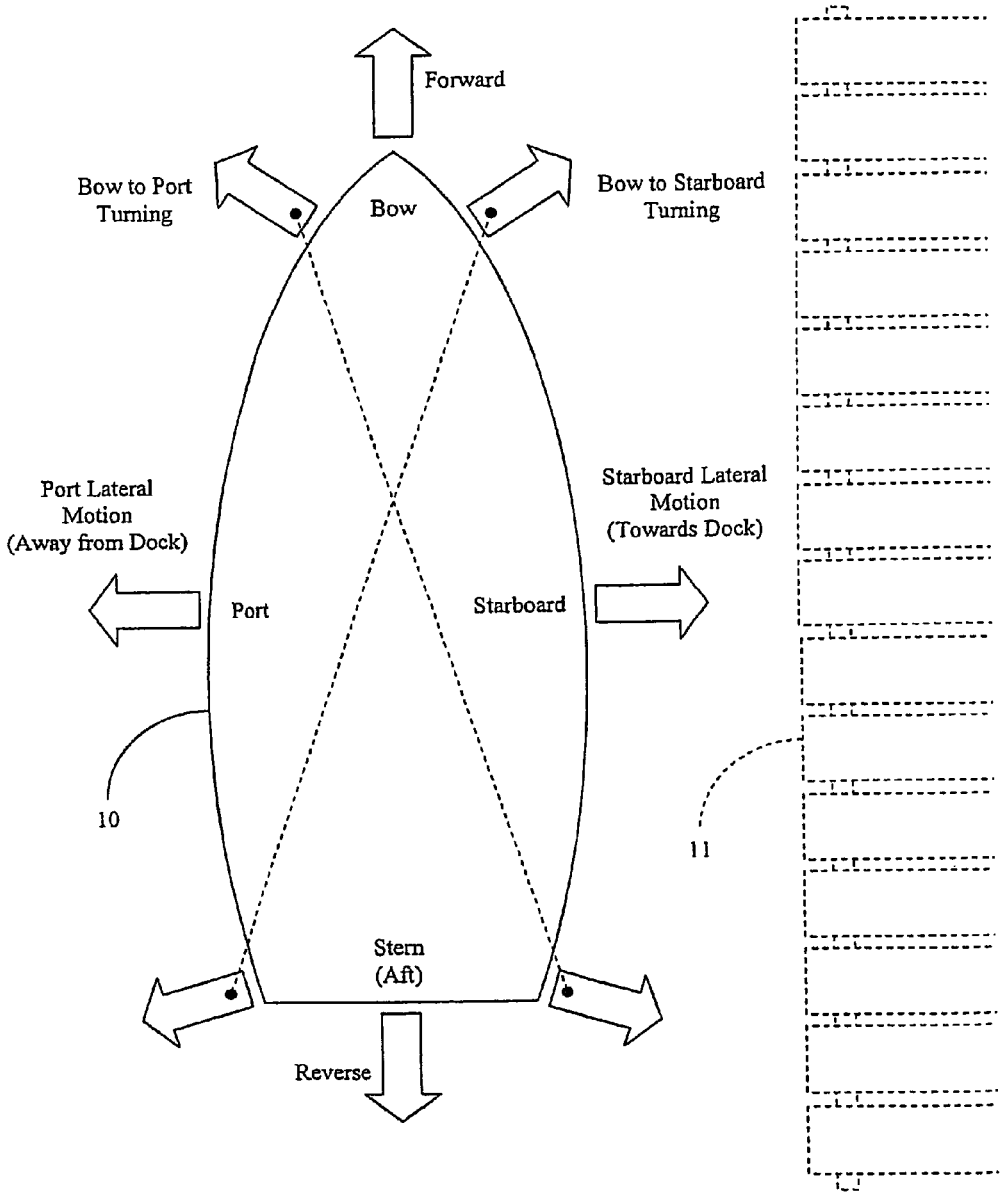
FIG. 1 is a schematic plan view of a typical small to medium sized watercraft positioned adjacent a dock or quay 100 disclosing the nomenclature for the various motions associated with the watercraft.

Reference is made first to FIG. 1 for a brief overview of the nomenclature associated with the movement of a small to medium sized watercraft positioned adjacent to and moving towards or away from a dock or quay. In FIG. 1, watercraft 10 is positioned generally parallel to dock 11 as it might be moving towards the dock 11 or away from the dock 11. In this configuration, the four directional orientations for watercraft 10 are shown. These include the bow (towards the top of the figure), the stern or aft (towards the bottom of the figure), the starboard side (toward the right hand side of the figure), and the port side (to the left hand side of the Drawing Figure). In this configuration, the watercraft 10 is shown with its starboard side toward dock 11.

The motions that are controlled by the apparatus and methods of the present invention include each of the six motions identified in FIG. 1. As is typical with most small to medium sized watercraft, the motor control system is capable of a basic forward and a basic reverse motion. In most cases the operator of the watercraft must manipulate the steering rudders (typically by a steering wheel or the like) in conjunction with the forward and reverse motions of the watercraft in order to effect docking with the stationary dock 11. The present invention provides additional control devices and methods that allow for improved motion control over the watercraft during the docking maneuver. In addition to the basic forward and reverse motions, the present invention permits control over a starboard lateral motion (towards the dock in this case) as well as a port lateral motion (away from the dock in this case). In addition, control mechanisms within the throttle handle system allow for bow to starboard turning, as well as bow to port turning as indicated in FIG. 1. The bow to starboard turning may be accomplished by directing the stern toward port, the bow towards starboard, or a combination of the two (shown by dashed connecting line between the arrow vectors in FIG. 1). Likewise, a bow to port turning may be accomplished by directing the stern toward starboard, the bow towards port, or a combination of the two (again, indicated by the connecting dashed line in FIG. 1).

In summary, the various slower motion actions associated with the docking or undocking of a watercraft are exhibited in FIG. 1 for which the apparatus and methods of the present invention provide specific control.

Figure 2:
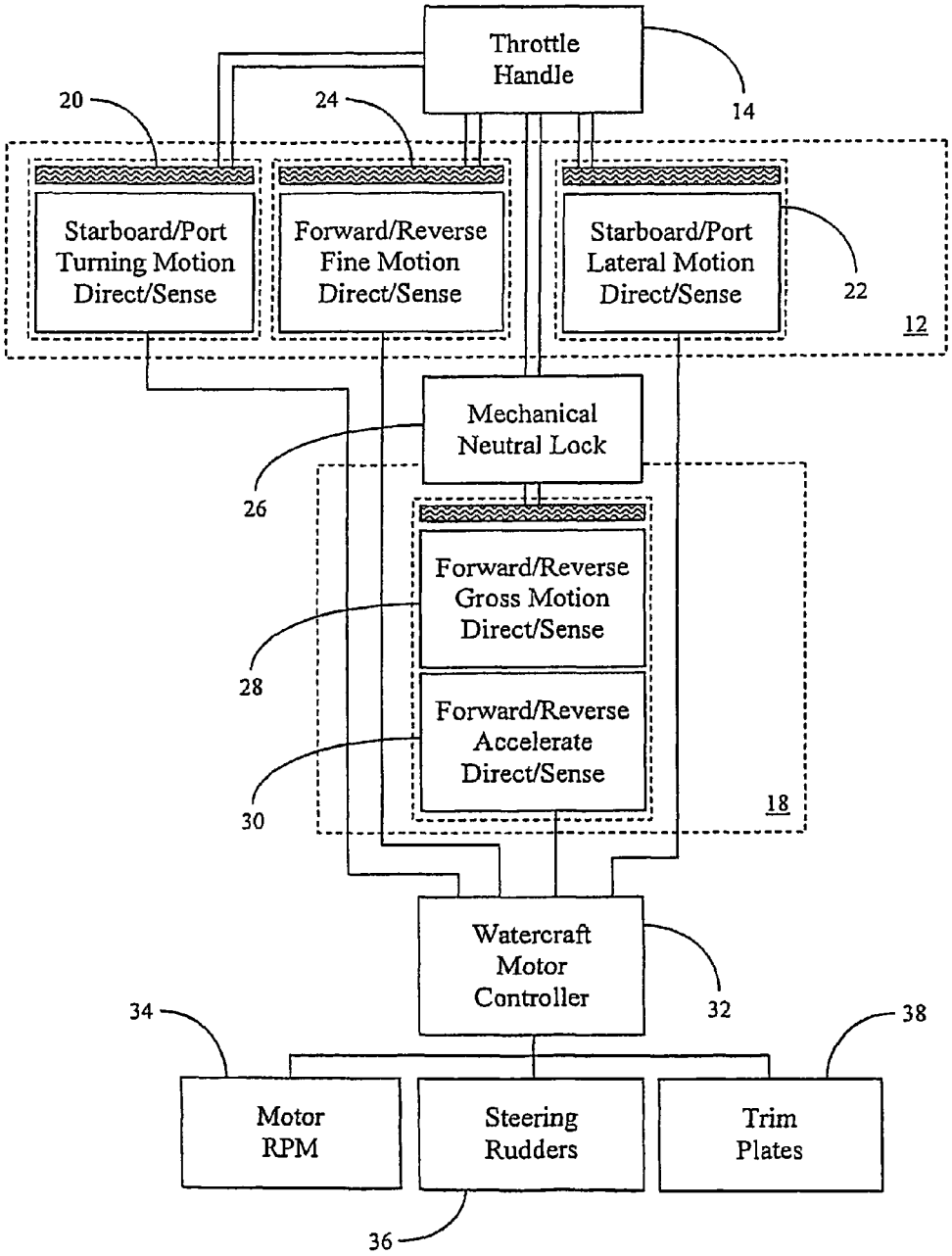
FIG. 2 is a functional block diagram showing the mechanical and electrical, linkages and connections, in the system of the present invention.

Reference is now made to FIG. 2 for an overview of the system of the present invention described in a functional block diagram. In FIG. 2, the overall system of the present invention is shown to include throttle handle 14 which is mechanically connected (double lines) to throttle arm 12 comprising the components surrounded by the dashed line. Throttle handle 14 is mechanically connected to starboard/port turning motion director/sensor 20, as well as starboard/port lateral motion director/sensor 22, and forward/reverse fine motion director/sensor 24. In addition, by way of mechanical neutral lock 26, throttle handle 14 is connected to forward/reverse director/sensor 28, and the associated forward/reverse acceleration director/sensor 30.

As suggested by the dashed outline boxes in FIG. 2, the various structural components of the throttle assembly are mechanically connected to each other and include electrical/electronic connections to convey control signal data to the watercraft motor controller 32. In particular, throttle handle 14 is mechanically connected to throttle arm 12 and through this mechanical connection couples a motion sensor to mechanical components on throttle handle 14 so as to translate the motion of throttle handle 14 into a control signal directed motion for the watercraft. The shaded plates shown in FIG. 2 associated with each of the director/sensor components are intended to imply a moving component that is sensed by an electronic sensor that then provides a control signal reflective of the throttle motion to watercraft controller 32.

Motion director/sensors 20, 22 and 24 serve to sense manual movement of the throttle handle 14 relative to the throttle arm 12. In their most basic form, such motion director/sensors 20, 22 and 24 may be split component sensors, which means that (i) they have two components or groups of components and (ii) that they function to detect movement of one of the components or groups relative to the other. As evident to those of skill in the art, one of the two split components or groups of components of each of motion director/sensors 20, 22 and 24 is on (or in fixed relation to) the handle 14, and the other of the two split components or groups of components is on (or in fixed relation to) the throttle arm 12. Such motion director/sensors 20, 22 and 24 may be split component sensors comprising a plurality or an array of permanent magnets whose motion relative to a spaced-apart, but magnetically adjacent, sensor, may be measured and utilized to sense the manual motion of the handle 14 relative to the throttle arm 12, which in turn reflects the intended motion of the watercraft as manually indicated by the operator. The positioning and placement of these split sensors 20, 22, and 24 must, of course, relate to the particular manner in which the throttle handle 14 moves with respect to throttle arm 12, or in the case of one of the alternate embodiments described below, the manner in which an upper section of the throttle arm moves with respect to a lower section of the throttle arm.

The other motion director/sensor—namely forward/reverse director/sensor 28—serves to sense motion for the customary function of throttle arms—to sense manual pivotal movement of the throttle arm 12 relative to its base. Forward/reverse director/sensor 28 also may be a split component sensor, such that one of its split components or groups of components is on (or in fixed relation to) the throttle arm 12, and the other of the two split components or groups of components is on (or in fixed relation to) the base about which throttle arm 12 pivots. Likewise, motion director/sensor 28 may be a split component sensor comprising a plurality or an array of permanent magnets whose motion relative to a spaced-apart, but magnetically adjacent, sensor, may be detected and utilized to sense the manual motion of the throttle arm 12 relative to its base, which in turn reflects the intended gross forward/reverse motion of the watercraft as manually indicated by the operator. The positioning and placement of split sensor 28 must, of course, also relate to the particular manner in which the throttle arm 12 moves with respect to its base. The forward/reverse motion director/sensor component 28 associated with the gross forward and reverse motion of watercraft 10 may reside in its ordinary place at or near the rotating/pivoting base 18 of the throttle arm 12.

Each of the throttle handle and arm motion sensors are electrically or electronically connected to watercraft motor controller 32. Motor controller 32 includes engine speed controls, rudder controls, and trim plate controls. Motor control is therefore electrically or mechanically connected to the watercraft motor 34, the watercraft rudders 36, and the watercraft trim plates 38.

Figure 3:
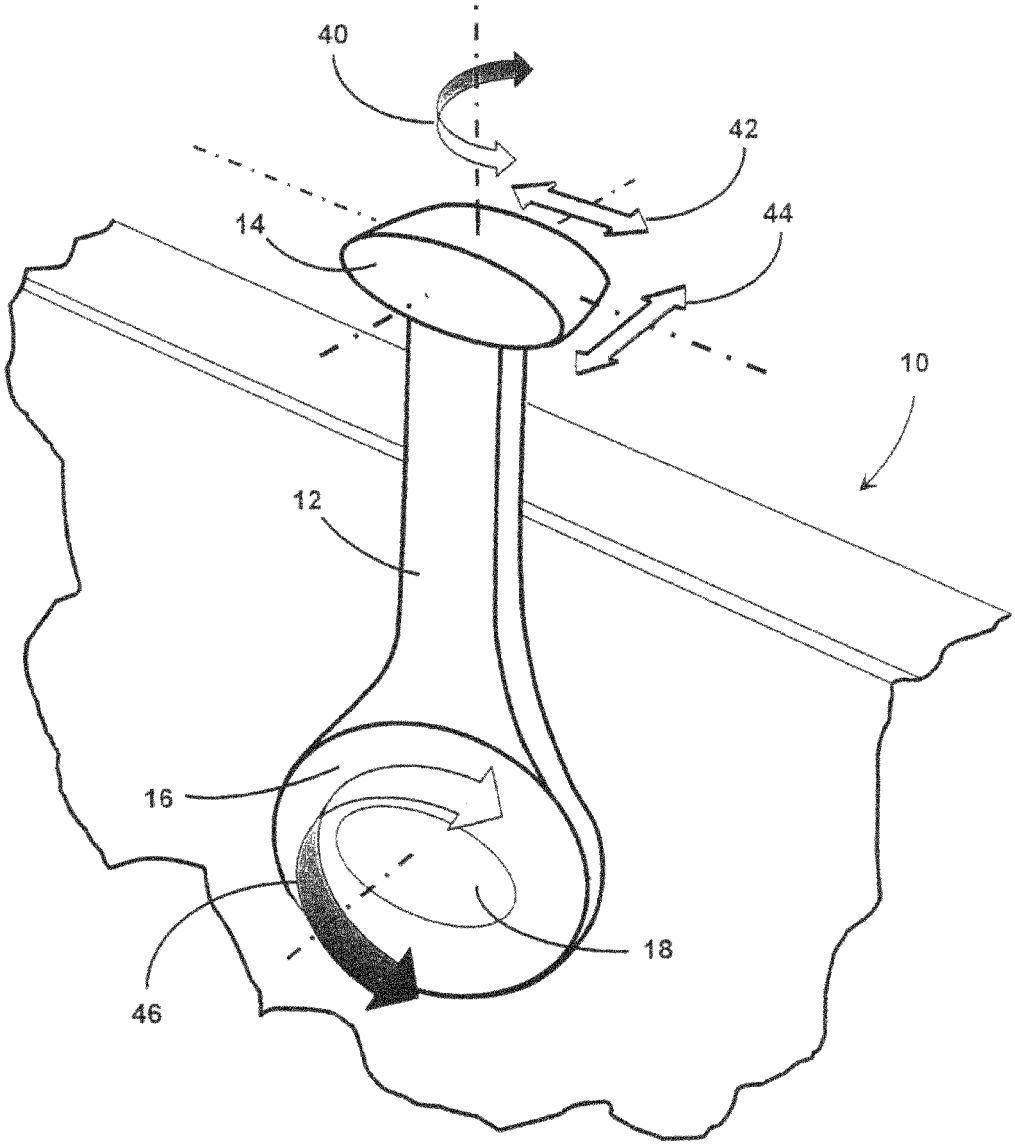
FIG. 3 is a perspective view of a first preferred embodiment of the throttle apparatus of the present invention, disclosing the use of throttle handle rotational and translational/lateral motion.

Reference is next made to FIG. 3 for a description of a first preferred embodiment of the present invention showing the throttle handle and arm structure of the apparatus implemented in a moveable throttle handle configuration. In this perspective view, throttle arm 12 is shown to support and retain throttle handle 14, which in this embodiment is capable of selected movement on its otherwise fixed position at the end of throttle arm 12. Throttle base rotating disc 16 connects throttle arm 12 to throttle arm stationary sensor apparatus 18 as is typically configured with mechanical/electrical throttles. The throttle assembly as described above is typically mounted on the interior of boat hull 10, usually on the inboard starboard side of the boat adjacent the operator's chair and steering mechanism.

The throttle assembly shown in FIG. 3 retains the standard operational and functional structures associated with a gross forward/reverse control 46. This forward and reverse control is typically associated with a mechanical neutral lock linkage (not shown) that allows the operator to move the throttle arm from a generally vertical locked position (neutral) to either a forward or reverse position as control of the watercraft requires. In most cases, the removal of the throttle arm from its neutral lock position is accomplished by way of a gripped push button or other electromechanical control button to release the throttle base rotating disc 16 from a locked condition with respect to stationary throttle components 18 to a rotating or pivoting condition.

In addition to the standard forward/reverse gross motor control typical with most throttle mechanisms, the first embodiment of the present invention adds additional controls associated with the motion of throttle handle 14 with respect to throttle arm 12. In this first embodiment, throttle handle 14 is configured to either remain fixed with respect to throttle arm 12 or to be released from its fixed configuration to effect the additional and finer controls over the motion of the watercraft. In the first preferred embodiment, this released motion of throttle handle 14 with respect to throttle arm 12 would typically only occur when the watercraft is in an otherwise locked neutral condition. The same mechanism that locks and releases the throttle arm from its standard neutral condition could effect the lock release function for throttle handle 14 with respect to throttle arm 12. Alternately, a second electromechanical control could serve to release and lock the new motion of throttle handle 14 with respect to throttle arm 12.

The basic control motions of throttle handle 14 with respect to throttle arm 12 are shown in FIG. 3 with the three axes of motion shown in dotted/dashed lines. A first rotational control (turning motion) 40 may be effected by simply turning throttle handle 14 in a clockwise or counter-clockwise rotation. This effects the bow to port or bow to starboard motions described in FIG. 1 above. In addition, a fine forward/reverse motion control 42 may be effected by laterally moving throttle handle 14 in a forward or reverse direction, effectively "sliding" across the top of throttle arm 12 a short but measurable distance. Various mechanisms for effecting this type of lateral motion are anticipated. In any event, this lateral motion effects the fine forward or reverse motions described in FIG. 1 above. Finally, a port/starboard lateral control motion 44 is effected by moving ("sliding") throttle handle 14 to the left or right across the top of throttle arm 12. This lateral motion effects the port or starboard movement (towards or away from the dock or quay 100) described in FIG. 1 below.

Those skilled in the art will recognize that the fine forward/reverse motion control 42 may be omitted and the continued use of the gross forward/reverse control 46 may achieve the required forward and reverse motions. In the preferred embodiment, however, a smoother and less abrupt forward and reverse control over the motor may be effected by this finer motion of throttle handle 14 with respect to throttle arm 12. In summary, a finer and more accurate control of the watercraft adjacent a dock may be effected by the three basic control motions functionally associated with throttle handle 14 in its released movement with respect to throttle arm 12.

Figure 4:
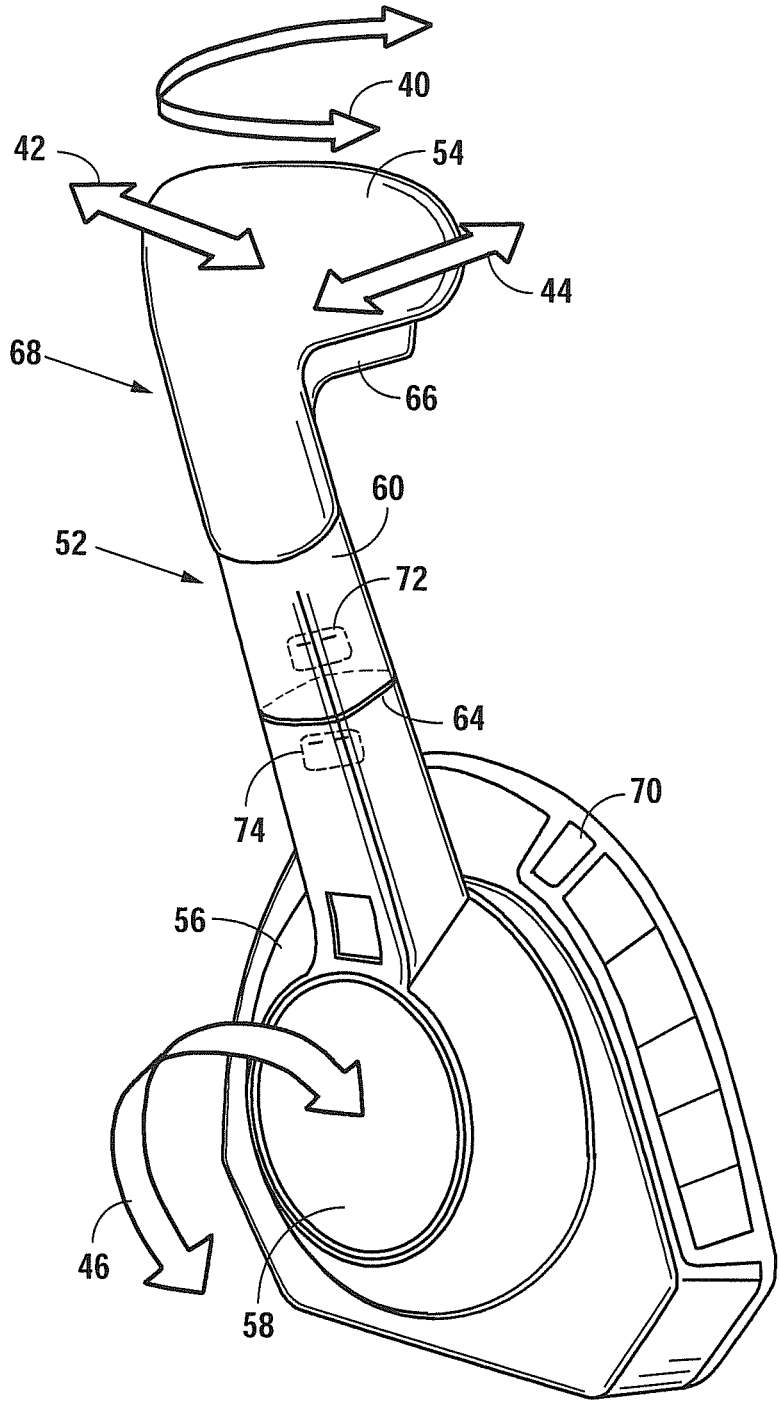
FIG. 4 is a second preferred embodiment of the throttle apparatus of the present invention disclosing the use of throttle arm rotational and translational lateral motion.

Reference is next made to FIG. 4 for a detailed description of a second preferred embodiment of the present invention shown implemented in conjunction with a variation of the basic throttle configuration for a small to medium sized watercraft. The basic motions of the throttle shown in FIG. 4 are the same as that shown in FIG. 3 except that the relative motion associated with the additional controls are situated within throttle arm 52 rather than between the throttle arm and the throttle handle. The throttle handle 54 in this embodiment is fixed on the top of throttle arm 52, but the throttle arm is divided into two parts, an upper throttle arm section 60 and a lower throttle arm section 62. The two throttle arm sections are retained in close proximity to each other and are capable of both a rotational motion with respect to each other, as well as orthogonal sliding translational motion, as described in more detail below. Various mechanisms for retaining the throttle arm sections together, while still permitting the above described motions, are anticipated. As with the first preferred embodiment, the relative motions of the throttle arm sections may be effected by a mechanical/electrical release mechanism controlled through the throttle handle as with the neutral position release mechanism controlled through the same.

In this second preferred embodiment, the same basic motions that are effected on the throttle handle in the first preferred embodiment may be effected on the upper portion of the throttle handle/throttle arm configuration as shown. These include the rotational control (turning) 40, the fine forward/reverse control 42, and the port/starboard lateral control 44. In this second preferred embodiment, imparting each of these three motions to the "split" throttle arm section may preferably be accomplished by tilting motions rather than sliding motions. In other words, while the rotational motion 40 may still be effected by simply turning throttle handle 54 and thereby turning upper throttle arm section 60 with respect to lower throttle arm section 62, the remaining two motions of the system of the present invention, fine forward/reverse control 42, and port/starboard lateral control 44, may best be effected by a tilting motion of the handle as opposed to a sliding motion. Again, various mechanical structures associated with the junction 64 between upper throttle arm section 60 and lower throttle arm section 62 are anticipated. The basic requirement in either of the two sub-embodiments described within FIG. 4 is that the relative motion between the two throttle arm sections can be measured by means of sensor elements 72 and 74 (shown in dashed outline form in FIG. 4).

Figure 5:
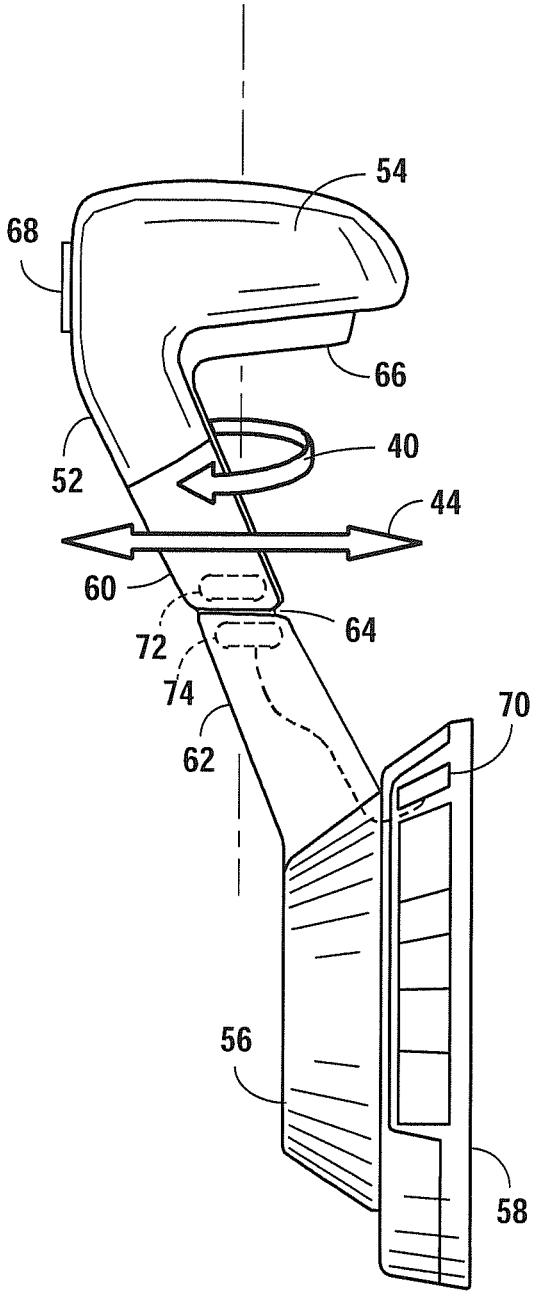
FIG. 5 is a side plan view of the embodiment of the throttle apparatus of the present invention shown in FIG. 4 (second preferred embodiment).

FIG. 5 shows in additional detail the structure of the embodiment shown in FIG. 4, wherein the relative motion between the upper throttle arm section 60 and the lower throttle arm section 62 are sensed by way of sensor elements 72 and 74. In the preferred embodiment, sensor element 72 may be a fixed permanent magnet, for example, or an array of permanent magnets, whose positions are detected and whose motions are identified by way of electronic sensor 74 which thereafter provides a control signal to the motor control systems of the watercraft responsive to the motion of the throttle.

Figure 6:
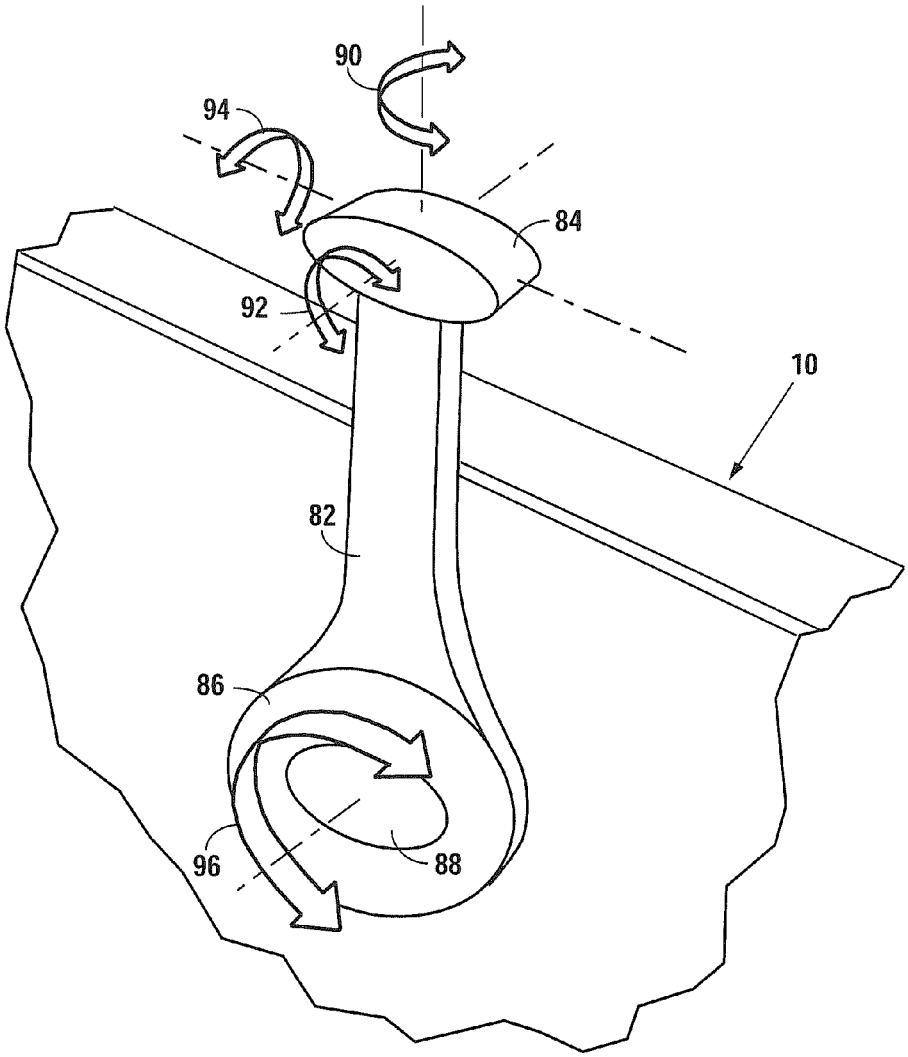
FIG. 6 is a perspective view of a third preferred embodiment of the throttle apparatus of the present invention disclosing the use of a throttle handle rotational and tilting motion.

Reference is finally made to FIG. 6 for a detailed description of a third preferred embodiment of the present invention, implemented again in conjunction with the motion of the throttle handle with respect to the throttle arm. In the perspective view shown in FIG. 6, throttle handle 84 is positioned on and retained by throttle arm 82. The remaining components associated with attachment of the throttle assembly to the boat hull 10 are as shown in FIG. 3, namely with throttle base rotational disc 86 and throttle arm stationary sensor assembly 88 serving their usual functions. In this embodiment, however, rather than the lateral motions of the throttle handle shown and described in FIG. 3, tilting and turning motions at throttle handle 84 may be made to effect the three basic motions of the watercraft. In this case, a rotational motion of throttle handle 84 once again effects a rotational control (turning motion) 90 for the watercraft, while a tilting forward or tilting backward around the lateral axis effects the fine forward/reverse motion control 92. In a similar manner, a tilting to the side around the longitudinal axis effects the port/starboard lateral control motion 94.

The electromechanical connections between the various moving components of the throttle handle assembly are as described above, or, with regard to gross forward/reverse control, are as is typical in the industry. The objective of the present invention is to provide finer, more sensitive motion control to the throttle handle, as in the nature of a joystick controller, to effect the finer motions required by the operator of the watercraft when approaching or departing from a dock. These finer motions are imparted to either the connection between the throttle handle and the throttle arm, as in the first and third embodiments, or between an upper and lower section of the throttle arm, as in the second embodiment. Once again, the second embodiment may operate in one of two manners, either through the sliding motion of the joint between the upper and lower sections of the throttle arm, or preferably through a tilting motion of the joint, again through mechanical structures capable of functioning much in the nature of a joystick or sliding controller.

Although the present invention has been described in conjunction with the above described preferred embodiments, alternate structures and functions will be anticipated by those skilled in the art that do not depart from the basic structures and method steps of the present invention. As there are many different types of small watercraft throttle assemblies, the basic principles of the present invention are generally capable of being implemented on most, if not all, of these various throttle assemblies. The electrical/electronic control signals that are required by the watercraft controller system may also vary depending upon the watercraft. The principles of the present invention are anticipated to operate well in conjunction with a wide variety of electrical/electronic control signal requirements.

Various existing throttle control assemblies may utilize separate or alternate control mechanisms for some of the finer motions associated with a watercraft in a docking or undocking mode. These alternate control mechanisms, however, are not integrated into the handle component of the throttle and therefore do not provide the same ease of use as the systems and methods of the present invention. As indicated above, one objective of the present invention is to provide all of the fine motor control necessary to effect a smooth and accurate docking action for the watercraft without the necessity of moving the operator's hand from the throttle control mechanism to some other steering control mechanism. Further modifications of the systems and methods of the present invention are anticipated that still fall within the spirit and scope of the claimed invention.

It is also recognized that the systems and methods of the present invention might be implemented in OEM products or as a retrofit device adaptable to any of a number of existing throttle/shift control systems. Still other alternatives are also within the scope of the invention for purposes of integrating a versatile throttle handle of the present teachings in boats with electronic engine interface, ZF transmissions and "Smart Command" control. As will be evident, in some retrofit environments, intermediate electronics may be necessary to translate the various rotational and translational displacements of the throttle handle to a signal recognizable by an existing electronic control unit. Various signal translators may be provided in order to match the sensor associated with such movements to the particular signal input requirements of a specific electronic engine control unit. Such modifications to achieve a retrofit application versus an original equipment system installation will be apparent to those skilled in the art.

Numerous other features, objects, advantages, alternatives, variations, equivalents, substitutions, combinations, simplifications, elaborations, distributions, enhancements, improvements or eliminations (collectively, "variations") will be evident from these descriptions to those skilled in the art, especially when considered in light of a more exhaustive understanding of the numerous difficulties and challenges faced by the art, all of which should be considered within the scope of the invention, at least to the extent substantially embraced by the invention as defined in the claims (including any added claims and any amendments made to those claims in the course of prosecuting this and related applications).

In all respects, it should also be understood that the drawings and detailed description herein are to be regarded in an illustrative rather than a restrictive manner, and are not intended to limit the invention to the particular forms and examples disclosed. Rather, the invention includes all variations generally within the scope and spirit of the invention as claimed. Any current, amended, or added claims should be interpreted to embrace all further modifications, changes, rearrangements, substitutions, alternatives, design choices, and embodiments that may be evident to those of skill in the art, whether now known or later discovered. In any case, all substantially equivalent systems, articles, and methods should be considered within the scope of the invention and, absent express indication otherwise, all structural or functional equivalents are anticipated to remain within the spirit and scope of the present inventive system and method.

What is claimed is:

1. An apparatus for controlling the movement of a watercraft, said apparatus comprising:

a. a control lever assembly including a base assembly and a control arm;

b. said control arm having a lever part and a handle;

c. the lever part of said control arm being connected at a proximal end to said base assembly, in pivotal relationship with said base assembly;

d. said base assembly being adapted for physical mounting to a watercraft in a fixed orientation on a surface of said watercraft, said watercraft having a propulsion system;

e. the handle of said control arm being positioned at a distal end of the lever part, the handle of said control arm being movably connected to the lever part of said control arm in a manner such that the handle is able to move both translationally and rotationally relative to the lever part of said control arm.

2. The apparatus of claim 1 wherein said control lever assembly further comprises sensors for detecting translational movement of the handle of said control arm relative to the lever part of said control arm.

3. The apparatus of claim 2 wherein said controller assembly further comprises controls to translate signals from said sensors to affect the operation of directional thrusters.

4. The apparatus of claim 1 wherein said control lever assembly further comprises sensors for detecting rotational movement of the handle of said control arm relative to the lever part of said control arm.

5. The apparatus of claim 1, wherein:

a. said control lever assembly further comprises sensors for detecting both translational movement and rotational movement of the handle of said control arm relative to the lever part of said control arm; and b. said controller assembly further comprises controls to translate signals from said sensors to affect the operation of directional thrusters.

6. The apparatus of claim 1, wherein:

a. said control lever assembly further includes a neutral lock linkage;

b. a throttle base rotating disc connecting said control arm to a control arm stationary sensor apparatus; and c. said neutral lock linkage is movable from a neutral lock position by way of a button to release said throttle base rotating disc from a locked condition to an unlocked position.

7. The apparatus of claim 6 wherein said neutral lock linkage locks said handle to said control arm, and can be released so as to unlock said handle from said control arm.

8. The apparatus of claim 7 wherein movement of a watercraft is dictated exclusively by said handle when said handle is locked to said control arm.

9. The apparatus of claim 6 allowing for the docking of a watercraft, wherein:

a. a plurality of sensors placed along the boat that detect the presence of boats and docks; and b. said controller assembly further comprises controls to translate signals from said sensors to affect the operation of directional thrusters.

10. The apparatus of claim 9, further comprising:

a. a docking mode switch is located on said control lever assembly; and b. said docking mode switch, is electronically connected to said directional thrusters and said neutral lock linkage.

11. The apparatus of claim 1 wherein said handle is movable in three axes of motion with respect to said control arm;

a. said handle is capable of clockwise and counter-clockwise rotation about the control arm;

b. said handle is capable of forward and reverse motion across the control arm; and c. said handle is capable of left and right motion across the control arm.

12. The apparatus of claim 1, wherein:

a. said control lever assembly further comprises sensors for detecting both translational movement and rotational movement of the handle of said control arm relative to the lever part of said control arm;

b. said controller assembly further comprises controls to translate signals from said sensors to affect the operation of directional thrusters;

c. said control lever assembly further includes a neutral lock linkage;

d. a throttle base rotating disc connecting said control arm to a control arm stationary sensor apparatus;

e. said neutral lock linkage is movable from a neutral lock position by way of a button to release said throttle base rotating disc from a locked condition to an unlocked position;

f. a plurality of sensors placed along the boat that detect the presence of boats and docks;

g. said controller assembly further comprises controls to translate signals from said sensors to affect the operation of directional thrusters;

h. a docking mode switch is located on said control lever assembly; and i. said docking mode switch, is electronically connected to said directional thrusters and said neutral lock linkage.

13. The apparatus of claim 2 wherein said handle is mechanically connected to said control arm and through this mechanical connection and couples a motion sensor to an auxiliary device.

14. The apparatus of claim 2 wherein said sensors are split component sensors comprising a plurality of permanent magnets that are spaced apart, but magnetically adjacent.

15. The apparatus of claim 2 wherein a fine adjustment of said handle effectuates a fine movement of a watercraft.

16. An apparatus for controlling the movement of watercraft, comprising:

a. a throttle handle and a throttle arm structure; and b. said throttle arm structure being divided into two parts, an upper throttle arm section and a lower throttle arm section, wherein the two throttle arm sections are retained in close proximity to each other and are capable of both rotational motion with respect to each other, as well as orthogonal sliding translational motion.

17. The apparatus of claim 16 wherein a relative motion of said throttle arm sections is affected by a mechanical release mechanism controlled through the throttle handle.

18. The apparatus of claim 16 wherein said upper portion of the throttle arm is moveable in three axes of motion;

a. a first rotational control effected by turning said upper throttle arm section in a clockwise or counter-clockwise rotation, thereby effecting the bow to port or bow to starboard motions;

b. a fine forward/reverse motion control effected by laterally moving said upper throttle arm section in a forward or reverse direction; and c. a port/starboard lateral control motion effected by moving said upper throttle arm section in a left or right direction, thereby effecting the port or starboard movement.

19. The apparatus of claim 16 wherein the relative motions of said throttle arm sections are measured with one or more sensor elements.

20. The apparatus of claim 19 wherein each sensor element is a plurality of permanent magnets, which thereafter provide a control signal to a motor control system of a watercraft, responsive to the motions of said throttle handle and said throttle arm structure.

21. An apparatus for controlling the movement of watercraft, comprising:

a. a control lever assembly including a base assembly and a control arm;

b. said control arm having a lever part and a handle;

c. said lever part of said control arm being connected at a proximal end to said base assembly, in pivotal relationship with said base assembly;

d. said base assembly being adapted for physical mounting to a watercraft in a fixed orientation on a surface of said watercraft, said watercraft having a propulsion system; and e. said handle of said control arm being positioned at a distal end of said lever part, said handle of said control arm being movably associated with said proximal end of said lever part in a manner such that said handle is able to move in at least two degrees of motion with respect to said proximal end of said arm.

* * * * *